United States Patent [19]

Koziol et al.

[11] Patent Number: 4,642,173

[45] Date of Patent: Feb. 10, 1987

[54] CELL HAVING COATED VALVE METAL ELECTRODE FOR ELECTROLYTIC GALVANIZING

[75] Inventors: Konrad Koziol, Röthenbach a.d. Pegnitz; Erich Wenk, Nürnberg, both of Fed. Rep. of Germany

[73] Assignee: Conradty GmbH & Co. Metallelektroden KG, Rothenbach a.d. Pegnitz, Fed. Rep. of Germany

[21] Appl. No.: 735,627

[22] Filed: May 20, 1985

[30] Foreign Application Priority Data

Jun. 8, 1984 [DE] Fed. Rep. of Germany ..... 3421480

[51] Int. Cl.[4] ..... C25D 7/06; C25B 11/02

[52] U.S. Cl. ..... 204/242; 204/27; 204/288; 204/289; 204/290 F; 204/279

[58] Field of Search ..... 204/55 R, 55 Y, 286, 204/288, 289, 290 R, 290 F, 279, 27

[56] References Cited

U.S. PATENT DOCUMENTS

| | | | |
|---|---|---|---|
| 3,761,384 | 9/1973 | Ruthel et al. | 204/288 |
| 4,022,679 | 5/1977 | Koziol et al. | 204/290 F |
| 4,116,802 | 9/1978 | Smith | 204/290 F |
| 4,141,814 | 2/1979 | Boulton | 204/290 F |
| 4,149,956 | 4/1979 | Bess, Sr. et al. | 204/289 |
| 4,391,695 | 7/1983 | Koziol et al. | 204/290 R |
| 4,392,937 | 7/1983 | Schmitt et al. | 204/288 |
| 4,452,685 | 6/1984 | Woodard, Jr. et al. | 204/290 R |

FOREIGN PATENT DOCUMENTS

| | | | |
|---|---|---|---|
| 1099434 | 1/1968 | United Kingdom | 204/290 F |

*Primary Examiner*—Terryence Chapman
*Attorney, Agent, or Firm*—Lyon & Lyon

[57] ABSTRACT

Such a coated valve metal electrode consists of at least one current feed and at least one current distributor. Current feed and current distributor are mechanically and electrically conductively connected via sheet-like connection elements. The active surface of this electrode consists of lamellas of valve metal having an active surface coating.

The essential features of this electrode consist in that the coated overall surface of the lamellas $F_A$ and the surface $F_P$ assumed by the overall arrangement of the lamellas (length and breadth of the electrode surface) have a surface factor such that $20 \geqq F_A/F_P \geqq 4$, preferably such that $14 \geqq F_A/F_P \geqq 6$, and in that the greater proportion of the coated surface of the lamellas is directed perpendicularly to the surface of the strip to be coated.

11 Claims, 7 Drawing Figures

CELL HAVING COATED VALVE METAL ELECTRODE FOR ELECTROLYTIC GALVANIZING

The invention relates to a coated valve metal electrode for electrolytic deposition of metals from aqueous solutions of the metal salts onto flat metal material moving relative to this, in particular a strip, preferably an anode for electrolytic galvanizing with zinc, consisting of at least one current feed, at least one current distributor electrically connected thereto and an active surface arranged thereon which is directed towards the metal strip.

The continuous eletrolytic coating of flat materials of metal, i.e. of strips and sheets, in particular electrolytic galvanizing, is already a relatively old technology (DE-PS 250 403; DE-PS 689 548). In this continuous electrolytic galvanizing, zinc is deposited from aqueous solution of its salts onto cold rolled strip or sheet from coils of soft unalloyed steels, in general constructional steels or of high tensile steels suitable for cold working. The electrode is connected as an anode and the strip as a cathode. In one working process, one-sided or double-sided galvanizing can be carried out, it being possible in double-sided coating to produce various coating thicknesses. The strip direction and thus the electrode arranement can be horizontal, vertical or radial, i.e. with curved electrodes in the form of an arc of a circle, the radial arrangement naturally permitting only one-sided coating.

In recent years, the described technology has awakened renewed interest. In addition to the electrical industries and manufacturers of domestic goods, the automobile industry above all is introducing electrolytically galvanized sheets into chassis constructions. The zinc coating protects the steel sheet actively against corrosion and with additional outer surface treatments such as phosphating, washed chromate, or passivised chromate, is particularly well suited for subsequent painting.

A known arrangement for electrolytic galvanizing of rolled strip (DE-OS 29 17 630) is characterised in that the electrolyte in the bath is guided with relatively high speed parallel to the strip upper surface and opposed to the direction of strip movement. Thus, the material transport ot the strip effective as cathode is intended to be improved for prevention of dendritic crystal development and for improvement of the flow exploitation in hydrodynamic manner. Insoluble anodes are used in this arrangement which consist either of carbon or of lead with a copper core. Such anodes are however problematic with high current densities because they are subject to high wear and show non-uniform current distribution. Furthermore, these anodes present continuous surfaces so that in particular with a horizontal arrangement the resulting gas, that is to say oxygen on the anode and hydrogen on the strip cannot be adequately removed. This applies particularly for the region below the strip. The gas which is not carried away hinders and slows the galvanizing process with the consequence of insufficient operational efficiency of the installaion. With lead arrangements, the additional disadvantage appears that the lead is introduced into the zinc deposited on the sheet whereby the corrosion protection is impaired and adhesion of paint adversely affected.

In a further known method for electrolytic deposition of metals from aqueous solutions of metal salts on coils of steel of the relevant type (European Patent Application Publication No. 0 100 400), for improvement of the electrolyte movement and thus of the desired reduction of the flow boundary layer thickness and thus of the diffusion layer thickness, the electrolyte flow directed along the plane of the steel strip, which flow takes place at low pressure, is changed into a turbulent flow condition by means of high pressure secondary flows transversely of the direction of movement of the strip. A device working according to this method is however relatively complicated because the guidance of the electrolyte must include a high pressure and a low pressure part. This requires a relatively large expenditure for tubes, nozzles and similar parts and in some circumstances for two reprocessing devices for the two electrolyte flows. A further disadvantage results from the fact that in this method self-consuming anodes are employed which naturally must be adjusted. It is however not possible with resettable electrodes always to maintain the smallest possible spacing between the anode and the steel strip in the necessary constant manner in order to minimize the voltage loss.

Whilst in the above-described apparatus the electrolyte is guided parallel to the upper surface of the stirp, it is also possible to apply the electrolyte perpendicularly onto the strip upper surface and in this manner to direct the electrolyte across the upper surface. In a device for electrolytric treatment of a metal strip of this type (DE-OS 31 08 615), the electrodes are provided with at least one slot through which the electrolyte for the upper surface of the metal strip is forced out so that a suitable static pressure is created in the electrolyte which ensures that the metal strip is maintained at the smallest possible spacing between two oppositely-lying electrodes. In this arrangement it is however not considered that first of all the effective electrode surface is reduced by the slots, with the result that the current transport to the strip to be treated is adversely affected, and that on the other hand as a result of the provision apparently of only a few slots the strip is not acted upon sufficiently intensively and uniformly by the electrolyte. It is far more likely that in the flow between electrodes and strip dead zones or the like will occur, which cause insufficient ion transport in the driection of the strip as a result of the metal ion deficiency occurring there, which results in a layer formation thereon which does not conform with requirements.

Finally, in bench tests for high power galvanizing, inter alia a clad titanium anode of expanded titanium metal has already been employed. The electrolyte flow was forced through the openings of this titanium anode and thus this electrolyte flow was applied substantially perpendicularly onto the strip upper surface. Between this titanium anode and the strip a fiber fleece was arranged as a sort of distance piece. These bench tests are now to be verified in a pilot plant.

Everything considered, it can now be established that in the known methods and devices, the construction and type of anode both in respect of the current density to be achieved and also in respect of the effect of the anode on the electrolyte guidance has received relatively little attention.

It is an object of the invention to provide a valve metal electrode, e.g. anode, for the discussed processes which takes account of the requirements in high power operation and the problems which occur there.

This object is achieved with an electrode, in particular an anode, of the above-described type in that the active surface is formed from lamellas of valve metal having an active surface coating, in that the overall coated surface of the lamellas $F_A$ and the surface $F_P$ assumed by the overall arrangement of the lamellas (length×breadth of the electrode surface) has a surface factor such that $20 \geqq F_A/F_P \geqq 4$, preferably $14 \geqq F_A/F_P \geqq 6$, and in that the larger parts of the coated surfaces of the lamellas are directed perpendicularly to the surface of the strip to be coated, in that the current feed consists of a rod having a metal core which is a good electrical conductor, in particular copper, and a cladding of valve metal, in that the current distributor is formed by a rod of valve metal, in that the current distributor is mechanically and electrically conductively connected to the current feed via at least one sheet-like connection element of valve metal in such manner that the connection element is welded on the one hand to the cladding of the current feed and on the other hand to the current distributor.

The first consideration on which the invention is based consists in that the active surface of the electrode shoudl be opened up into an open structure consisting of mutually spaced parallel lamellas or rods with horizontal and vertical cells arranged in one plane and with radial cells arranged on the surface of a cylinder. These lamellas can be arranged very easily both on flat and on curved surfaces so that anodes according to the invention can be installed both with horizontal and vertical cells and also with radial cells.

Such an active surface of an electrode formed of lamellas is furthermore suitable to control and direct the pattern of the electrolyte flow. As has already been explained, for optimal processing, a particular electrolyte movement is necessary in order to reduce the diffusion layer thickenss on the cathode, i.e. onthe strip and simultaneously to prevent impermissibly large metal ion deficiencies of the electolyte in the civinity of the cathode. In addition, the type of gas removal occurring with the electrode according to the invention contributes to this. That is to say the gas can escape rapidly between the channels formed through the lamellas. The thus escaping gas disturbs the electrolyte flow in a type of pumping effect with the result that very rapid exchange of the electrolyte in the region of the outer surface of the strip with the remaining electrolyte volume. By this exchange, metal ion deficiency of the electrolyte in the region of the cathode, i.e. in the region of the strip, is counteracted.

The above explained pumping effect is reinforced with the electrode according to the invention in that according to a further feature of the concept accoridng to the invention the greater part of the coated surfaces of the lamellas are directed perpendicularly to the surface of the strip to be coated. The lamellas thus stand on edge, as seen in cross-section at right angles to the strip surface, thus possessing a larger height at right angles to the strip surface in relation to the width parallel to the strip surface. Owing to the fact that the larger amount of gas is evolved on the surface regions of the lamellas directed successively away from the strip at right angels to the strip surface, the gas flow is rapidly conducted away from the strip or the electrode. Thus, on the one hand the gas charge in the gap between the electrode and the strip remains small with reulting optimal operating efficiency for the coating process.

The described technique according to which the larger areas of the coated surfaces of the lamellas are directed at right angles to the surface of the strip to be coated, also considerably reduces wear of the electrodes according to the invention. Thus, as a result of mechanical rubbing between the strip and the electrode only the smaller part of the coated surface directed towards the strip and running parallel to the strip surface is subjected to mechanical wear. The larger part of the active upper surface of the electrode according to the invention is thus preserved. This ensures for the electrode according to the invention a kind of emergency operation property, i.e. further operation of the electrode is possible even with partially worn out surface coating.

The idea according to the invention of forming the active surface of the electrode according to the invention in the form of a lamella structure stands in close relation to the further basic concept of the invention of providing an electrode with large surface factor which is achieved in that the coated overall surface of the lamellas $F_A$ and the surface $F_P$ assumed by the overall arrangement of the lamellas (length×breadth of the electrode surface) has a surface factor such that $20 \geqq F_A/F_P \geqq 4$, perferably $14 \geqq F_A/F_P \geqq 6$. As a result, extremely high cathodic current densities can be achieved with relatively low current density and uniform current distribution on the active surface of the electrode according to the invention. As a result of the supportable current density on the electrode according to the invention with simultaneously high current densities for the electrolyte utilization process, the active surface coating which is suitably selected has a long working life. In addition, the described effect is achieved that as result of the lamella structure the "inner surface" which is also provided with an active surface coating, thus that part of the coated surface of the lamellas which is directed perpendicular to the surface of the strip to be coated, is subjected to no mechanical wear which likewise results in a long operational life and emergency operation characteristics of the electrode according to the invention.

A further feature of the solution according to the invention consists in that the current feed of the electrode is prepared from a rod having a core of highly electrically conductive metal, in particular copper. Such a construction permits transport of a sufficiently large amount of current with the smallest possible voltage drop. Furthermore, with the construction of such a current feed with flat cross-section this can be easily curved in relation to the respective broad surfaces so that this current feed can be very well adapted to the predetermined cell housing. In particular, such a current feed can be very easily bent at an angle so that with a horizontal cell the current feed then passing substantially vertically can be angled at the upper end in the direction of the current rail and on the lower end in the direction of the current distributor of the horizontally directed active surface.

Furthermore, the provisions according to the invention have the result that the connection between the current feed and the current distributor takes place via a connection element which on the one hand is welded to the cladding of the current feed and on the other hand is welded to the current distributor for rapid and inexpensive reactivation of the electrode according to the invention. By simple separation of the weld seam between the connection element and the current distributor, the current distributor including the lamellas arranged thereon can simply be removed so that the active surface can be recoated whilst the current feed and all other electrical components for current supply of the cell remain with the user. The user need only keep a stock of active parts in order to permit rapid reinstallation of the cells so that relatively little capital is tied up. The use of a cheap and relatively thin coating on the active parts becomes economically feasible only by the use of this simple separation and reconnection of the electrode according to the invention. Each connection element can consist of one sheet strip or several sheet strips. In the latter case, a separate sheet strip is provided for each current distributor.

Finally, the principal advantages of a coated valve metal electrode in the galvanizing processes under discussion should be described. The coating of this type of coated valve metal electrode is of course substantially more active than the lead which had primarily been used up until now. Oxygen evolution is thus possible with the electrodes according to the invention with lower anode potential. As a result, considerable reduction of the anodic component of the cell voltage is achieved. As a result of the large surface factor achieved with the electrode according to the invention, a further reduction of this anodic component of the cell voltage is achieved. All in all, considerable energy saving thus results.

On the other hand, with the electrode according to the invention, larger cathodic current densities can be achieved in the galvanization processes which enable higher coil speeds.

Out of the valve metals mentioned, primarily titanium would be used. If higher breakdown potentials are necessary, also tantalum, niobium or zirconium can be considered.

Everything considered, with the invention an electrode for high power galvanizing processes is made available which takes account of the requirements involved in this processing. In this connection, the experience is used which results from use of valve metal electrodes as such in other electrolytic and electrochemical processes.

The lamellas of the electrode according to the invention can either be constructed as solid wall lamellas or can be of expanded metal. When using an electrolyte flow parallel to the strip surface, in particular contrary to the direction of strip movement, with an appropriate arrangement of the lamellas of expanded metal transversely of inclined to the flow direction, the electrolyte flow can pass directly through these. As a result, the electrolyte flow is placed in a condition of increased turbulence which in addition contributes on the one hand to the cavitation effect or to the pumping effect achieved with the open structure of the electrode according to the invention for a rapid gas extraction and on the other hand contributes to reduction in size of the cathode side diffusion layer thickness and prevention of impermissible metal ion deficiency of the electrolyte in the region of the cathode. These effects are achieved in a substantially simpler manner than by loading the main electrolyte flow with high pressure electrolyte flows from the sides of the electrode as suggested by the state of the art.

With electroylyte flow parallel to the strip surface, it can be expedient in respect of optimization of the gas extraction that the lamellas which are either made solid or consist of expanded grid, are directed obliquely to the strip movement direction or to the electrolyte flow direction. The electrolyte flow is thus given a movement component in the direction of one edge of the strip to be coated. This electrolyte flow thus achieved directs a proportion of the evolved gas laterally from the strip.

With electrolyte flow directed parallel to the strip surface, the described effect is amplified even in the case in which the lamellas each consist of two arms connected together at an angle, the vertex of the angle pointing in the opposite direction to the direction of electrolyte flow. By this means, the electrolyte flow and with it the evolved gas is given components of motion in the direction of the two strip edges.

With vertical cells, and also for the upper electrodes in horizontal cells, and with parallel loading of the strip surface by means of the electrolyte flow, it can be recommendable to successively increase the mutually spacing of the lamellas in the direction of flow of the electrolyte. As a result, thus the gas passage surface between the lamellas in the flow direction of the electrolyte is increased continuously or in stages which takes account of the increasing evolution of gas in the direction of the electrolyte flow.

Finally, the lamellas can also however be arranged with their longitudianl extension parallel to the strip movement direction. The lamellas thus form channels in the direction of the flow of the electrolyte, whereby this can be directed with particularly high flow speed along the strip to be coated.

Whilst the preceding arrangements relate to the case in which the electrolyte is applied onto the strip parallel to the plane thereof, the possibility should also be mentioned of applying the electrolyte substantially perpendicularly to the strip to be coated. Also with such an electrolyte flow the electrode arrangement according to the invention can be employed with advantage. splitting of the active surface into rods, lamellas or the like thus makes available a large average overall surface for the electrolyte through the electrode so that the strip to be coated can be treated very intensively with the electrolytic solution whilst preventing the formation of dead zones in the flow. Also in this case, the lamellas achieve a type of nozzle effect which provides acceleration of the electrolyte flow.

With the substantially perpendicular treatment of the strip surface with the electrolyte, by means of appropriate height of the connection elements between the current feed and the current distributor it can be prevented that the current feed causes an area of stagnation in the electrolyte flow.

Furthermore, it can be recommendable to equip the respective current feed with a connection for the current supply on each of its oppositely lying ends. Thus, the electrode is supplied with current from the two mutually opposite sides. This favors further reduction of the voltage drop in the current feed.

It can furthermore be expedient to provide a plurality of current feeds for each active surface. This also leads to the concept of dividing an electrode surface into a plurality of sub-surfaces.

BRIEF DESCRIPTION OF THE DRAWINGS

Exemplary embodiments of the electrode according to the invention will be explained in more detail with reference to the drawings, in which:

FIGS. 1 and 2 relate to an anode according to the invention arranged for a vertical cell in which thus the anode and the strip guidance are vertically oriented in the region of the anode. Accordingly, on a current rail 1, which can consist entirely of copper, a vertically directed current feed 10 is mechanically and electrically conductively connected in such manner that the upper end of the current feed 10 is welded to a head plate 2 which in turn is secured by means of screws 3 to the current rail 1. As may be seen from the sectional view according to FIG. 2, the current feed consists of a core 11 of highly electrically conductive material, preferably copper, and a sleeve 12 consisting of valve metal, preferably titanium. The current feed 10 is connected to current distributors 20 extending at right angles, i.e. horizontal in the installed conditionof the anode, which likewise preferably consists of titanium, the connection being achieved in such manner that two sheel-like connection elements 30 extending parallel to the current feed 10 are welded to its sleeve 12 longitudinally of a weld seam 31, whilst on the other hand the current distributors 20 are welded to the opposed edges of the sheet-like connection elements 30 along the weld seam 32. The sheel-like connection elements 30 consist likewise expediently of titanium. the active surface 40 of this anode is formed of lamellas 41 which are arranged parallel and spaced from one another and extend vertically in one plane in the installed condition of the anode. The lamellas have in this connection a relatively narrow rectangular cross-section and are directed with their (larger) height at right angles to the current distributors 20 and thus at right angles to the strip to be coated and guided along the other side. The lamellas 41 themselves consist of valve metal, expediently likewise titanium, and are equipped with an active surface coating. As a result of the arrangement of the lamellas 41, their dimensions and their mutual spacing, the lamellas 41 satisfy the relationships that the coated overall surface of the lamellas $F_A$ and the surface $F_P$ assumed by the overall arrangement of the lamellas (length×breadth of the electrode surface 40) has a surface factor such that $20 \geqq F_A/F_P \geqq 4$ and that the larger part of the coated surface of the lamellas 41 is directed at right angles to the surface of the strip to be coated.

FIG. 3 shows an anode according to the invention adapted to a horizontal cell in which thus the anodes and the guidance of the strip are oriented in the region of the anode in a horizontal direction. In this connection, the same components are provided with the same reference signs. In this case, accordingly, two current feeds 10 are provided for each anode and form a double angle so that each upper horizontal limb 13 can be connected to a current rail, the vertical limb 14 extends into the cell and the active surface 40 of the anode is connected to the horizontal limb 15. This results in analogous manner via sheet-like connection elements 30 which are welded to the current feed 10 on respective sides of the respective horizontal limb 15 and parallel to this and are welded at their other sides to the current distributors 20 extending at right angles to the current feeds. On the lower surfaces of the current distributors 20, the lamellas 41 are arranged which provide the active surface 40 of the anode. These lamellas 41 likewise satisfy the above given relationships.

Figure 1:
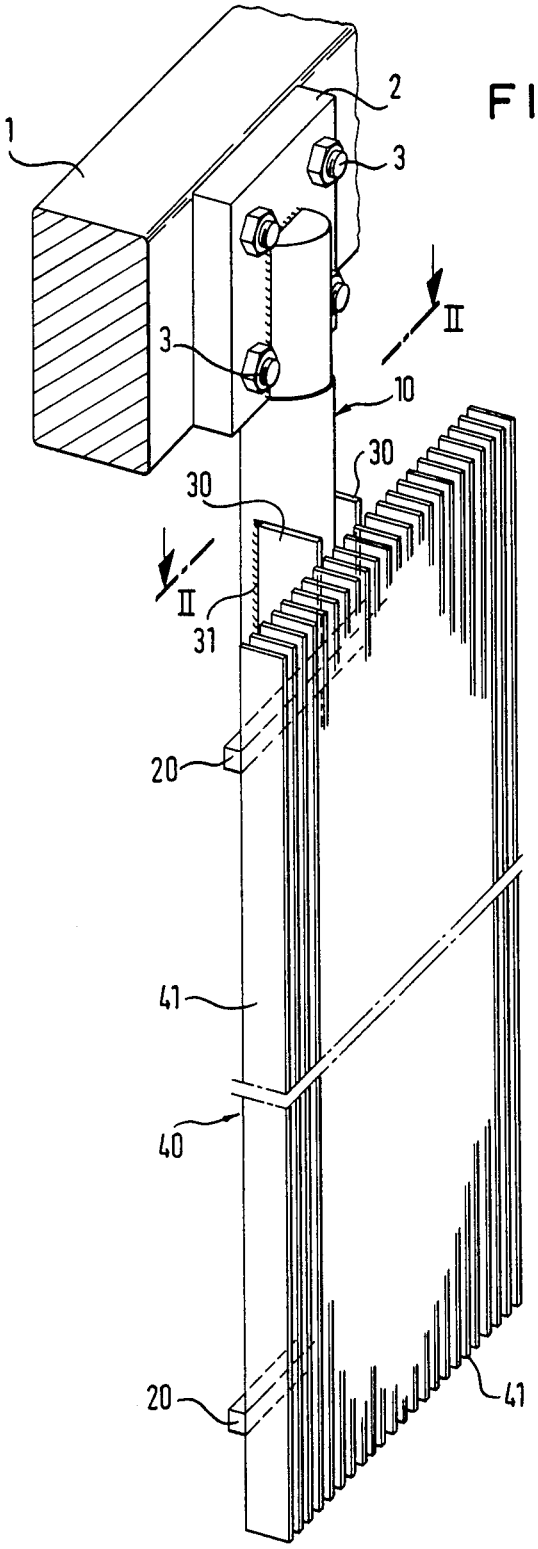
FIG. 1 shows a perspective view of an anode according to the invention for a vertical cell.
Figure 2:
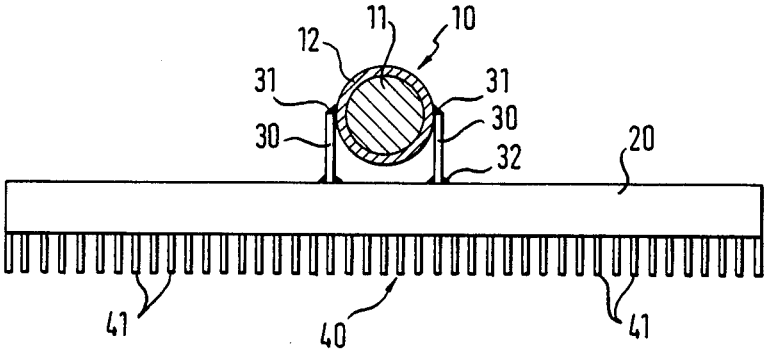
FIG. 2 shows a section through the arrangement according to FIG. 1 along the section line II—II.
Figure 3:
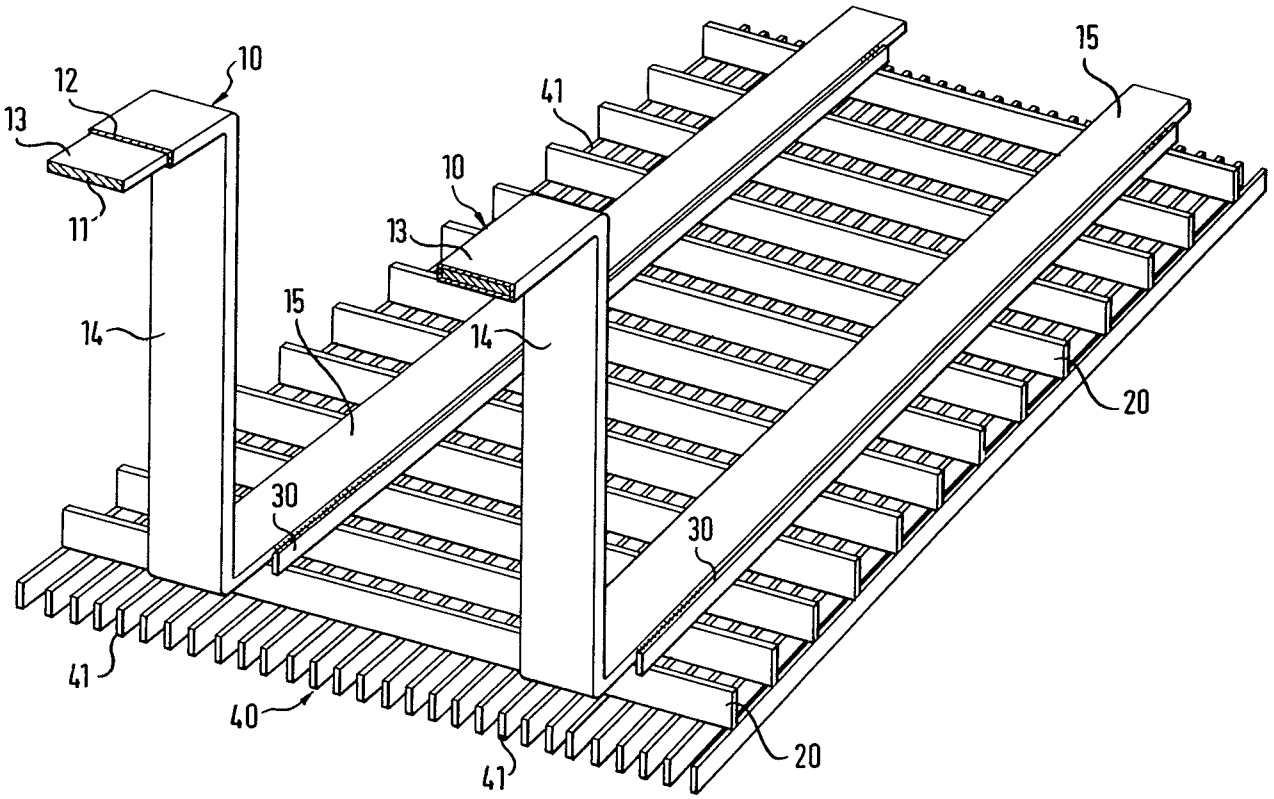
FIG. 3 shows a perspective view of an anode according to the invention for a horizontal cell.

Also in the arrangement according to FIG. 3, the current feeds consist of a core of highly electrically conductive metal, in particular copper, and of a cladding of valve metal, in particular titanium. The current feed 10 however has in contrast to the arrangement according to FIGS. 1 and 2 a flat rectangular cross-section, the angular bending being carried out about a wider side. It has proved that such bends can be carried out without problems with the composite construction.

The sheet-like connection elements 30 need not be provided as continuous members. It suffices if they are constructed as short elements in such manner that such a connection element 30 is assigned to each current distributor 20.

Figure 4:
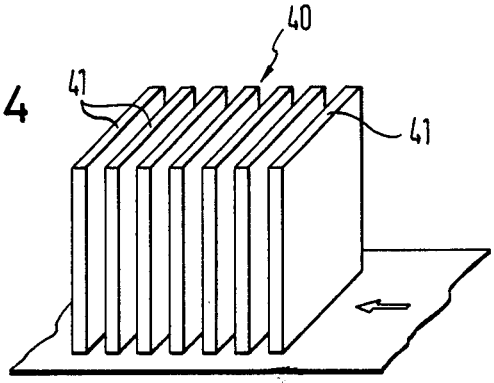
FIGS. 4 to 7 show schematic perspective views of possible arrangements of lamellas of the active surface of the anode according to the invention in relation to the guidance of the strip and electrolyte.

FIG. 4 shows an arrangement of the lamellas 41 of the active surface 40 of an anode according to the invention of such type that the lamellas 41 are directed, in regard to their longitudinal extension, transversely of the direction of movement of the strip indicated with an arrow. Preferably, the direction of movement of the electrolyte is opposed to the strip movement direction. With this orientation of strip and electrolyte flow, the lamellas 41 expedient consist of expanded metal, whereby the electrolyte flows through the lamella surfaces themselves and is thus set in a condition of great turbulence.

Figure 5:
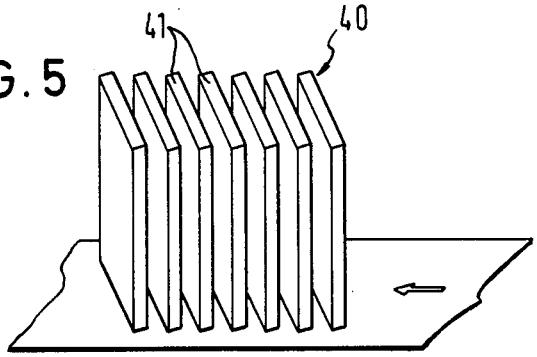

According to FIG. 5, the lamellas 41 of the active surface 40 of the anode according to the invention are arranged obliquely to the direction of the strip movement. As a result, the electrolyte flow directed parallel to the strip surface is given a component of motion in the direction of one edge of the strip to be coated, whereby removal of gas also takes place in this direction.

Figure 6:
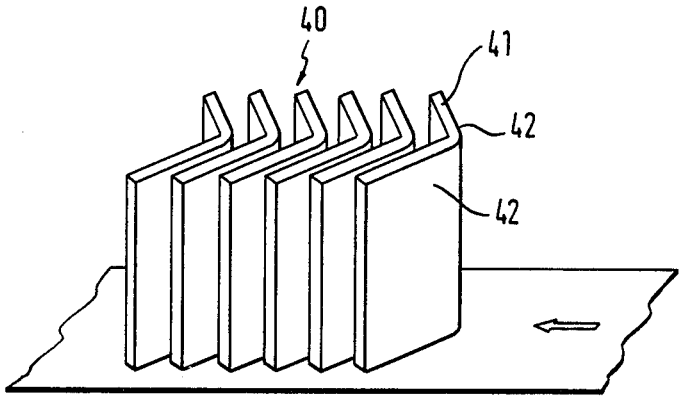

The arrangement according to FIG. 6 serves the same purpose, in which the lamellas 41 of the active surface 40 of the anode according to the invention each consist of two mutually angled limbs 42. The apex of these angled lamellas 41 is expediently directed oppositely to the direction of electrolyte flow, whereby this receives a component of motion in the direction of both edges of the strip.

Figure 7:
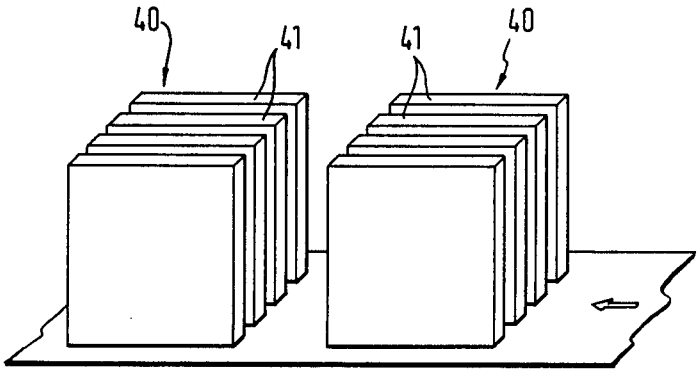

Finally, FIG. 7 shows an arrangement of the lamellas 41 of the active surface 40 of the anode according to the invention parallel to the direction of strip movement and to the electrolyte flow. Also in this case, the lamellas achieve a sort of nozzle effect which accelerates the electrolyte flow.

We claim:

1. In an apparatus for electrolyte deposition of metal from aqueous solution of a metal salt onto an elongated strip of metal as the strip is drawn longitudinally past a positively charged anode submerged in a bath of electrolyte solution, an anode structure, comprising:

at least one current feed, at least one current distributor electrically conductively connected to said feed;

an active surface on said distributor which is directed towards the metal strip;

the active surface being oriented in comformity with the predetermined path of the metal strip;

the active surface being formed as lamellas of valve metal having an active surface coating;

the entire coated surface of the lamellas $F_A$ and the surface $F_P$ assumed by the overall arrangement of the lamellas (length times breadth of the electrode surface) having a surface factor such that $20 \geqq F_A/F_P \geqq 4$;

the larger portions of the coated surfaces of the lamellas being directed perpendicularly to the surface of the strip to be coated;

the current feed consisting of a rod having a core of highly electrically conductive metal and cladding of a valve metal;

the current distributor being formed from a rod of a valve metal; and the current distributor being mechanically and electrically conductively connected to the current feed via at least one sheet-like connection element of a valve metal in such manner that the connection element is welded both to the cladding of the current feed and to the current distributor.

2. Electrode according to claim 1 wherein $F_P$ and $F_A$ satisfy the relation $14 \geqq F_A/F_P \geqq 6$.

3. Electrode according to claim 1 wherein the lamellas of the active surface are formed as solid walled lamellas.

4. Electrode according to claim 1 wherein the lamellas of the active surface consist of expanded metal.

5. Electrode according to claim 1 wherein the lamellas extend transversely to the direction of motion of the strip in respect of their longitudinal extension.

6. Electrode according to claim 1 wherein the lamellas are directed obliquely to the direction of motion of the strip in respect of their longitudinal extension.

7. Electrode according to claim 6 wherein the lamellas consist of two limbs connected together at an angle.

8. Electrode according to claim 1 wherein the lamellas are directed longitudinally of the direction of motion of the strip in respect of their longitudinal extension.

9. Electrode according to claim 1 wherein with application to the strip of electrolyte flow parallel to the strip surface the mutual spacing of the lamellas increases in the flow direction of the electrolyte.

10. Electrode according to claim 1 wherein the lamellas are zig-zag shaped considered in section parallel to the surface of the strip to be coated.

11. Electrode according to claim 1 wherein each current feed is provided with respective connections for the current supply on its oppositely lying ends.

* * * * *